United States Patent [19]

Seshamani

[11] Patent Number: 4,944,250

[45] **Date of Patent: * Jul. 31, 1990**

[54] CYCLONE SEPARATOR INCLUDING A HOPPER FORMED BY WATER-STEAM COOLED WALLS

[75] Inventor: Venkatraman Seshamani, Gillette, N.J.

[73] Assignee: Foster Wheeler Energy Corporation, Clinton, N.J.

[ * ] Notice: The portion of the term of this patent subsequent to May 24, 2005 has been disclaimed.

[21] Appl. No.: 330,541

[22] Filed: Mar. 30, 1989

[51] Int. Cl.[5] ..... B04C 5/08

[52] U.S. Cl. ..... 122/20 B; 55/269

[58] Field of Search ..... 55/269; 122/20 B

[56] References Cited

U.S. PATENT DOCUMENTS

| | | | |
|---|---|---|---|
| 1,890,170 | 7/1987 | Van Brunt | 122/235 A |
| 2,437,294 | 3/1948 | Dalin | 55/269 |
| 2,937,141 | 5/1960 | Helwig | 208/361 |
| 3,327,456 | 6/1967 | Guber, Jr. et al. | 55/269 |
| 3,470,678 | 10/1969 | Clark | 55/269 |
| 3,732,920 | 5/1973 | Kimmel | 165/119 |
| 4,746,337 | 5/1988 | Magol et al. | 55/269 |

FOREIGN PATENT DOCUMENTS

| | | | |
|---|---|---|---|
| 587240 | 4/1947 | United Kingdom | 55/269 |

*Primary Examiner*—Bernard Nozick

*Attorney, Agent, or Firm*—Marvin A. Naigur

[57] ABSTRACT

A cyclone separator formed by a plurality of parallel tubes. A portion of the tubes form a cylinder, a portion are bent radially inwardly to form a roof and a portion are bent to form a hopper. Water is passed through tubes to cool the separator.

7 Claims, 1 Drawing Sheet

CYCLONE SEPARATOR INCLUDING A HOPPER FORMED BY WATER-STEAM COOLED WALLS

BACKGROUND OF THE INVENTION

This invention relates to a cyclone separator and, more particularly, to such a separator for separating solid fuel particles from gases discharged from a combustion system or the like.

Conventional cyclone separators are normally provided with a hopper connected to their lower end to collect the solid particles from the separator. The separator and the hopper are usually provided with a monolithic external refractory wall which is abrasion resistant and insulative so that the outer casing runs relatively cool. Typically, these walls are formed by an outer metal casing and two inner insulative refractory materials to protect the outer casing from high temperatures and reduce heat losses. However, in order to achieve proper insulation, these layers must be relatively thick which adds to the bulk, weight, and cost of the separator and hopper and require controlled, relatively long, start-up and shut down times prevent cracking of the refractory. Also, the outside metal casing of these designs cannot be further insulated from the outside since to do so could raise its temperature as high as 1500° F. which is far in excess of the maximum temperature it can tolerate.

Further, most conventional cyclone separators require relatively expensive, high temperature, refractory-lined ductwork and expansion joints between the reactor and the cyclone, and between the cyclone and the heat recovery section, which are fairly sophisticated and expensive. Still further, conventional separators formed in the above manner require a relatively long time to heat up before going online to eliminate premature cracking of the refractory walls, which is inconvenient and adds to the cost of the process. Also, other cyclone separators may require a separate roof tube circuit which still further adds to the cost of the system.

SUMMARY OF THE INVENTION

It is therefore an objective of the present invention to provide a cyclone separator in which heat losses are reduced and the requirement for internal refractory insulation is minimized.

It is a still further object of the present invention to provide a cyclone separator of the above type in which the bulk, weight and cost of the separator are much less than that of conventional separators.

It is a still further object of the present invention to provide a cyclone separator of the above type in which the need for expensive, high-temperature, refractory-lined ductwork and expansion joints between the furnace and the cyclone separator and between the latter and the heat recovery section are minimized.

It is a still further object of the present invention to provide a cyclone separator of the above type which is formed by heat transfer tubes covering the conical, cylindrical and roof sections of the separator so that circulation of the steam-water mixture can be maintained in the tubes with an external pump or without the use of an external pump in a natural circulation boiler.

Toward the fulfillment of these and other objects, the separator of the present invention includes a cylinder a roof section and a hopper section all of which are formed by a plurality of tubes extending in parallel relationship. Ring headers are provided to pass cooling water, or steam, through the tubes. An inner cylinder is provided to define, with the cylinder of the separator, an annular chamber which receives a mixture of gases and solid particles for separating the solid particles from the gases by centrifugal forces. The solid particles fall the hopper section of the separator for disposal, or recycle, and the gases pass upwardly through separator to external heat recovery equipment.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
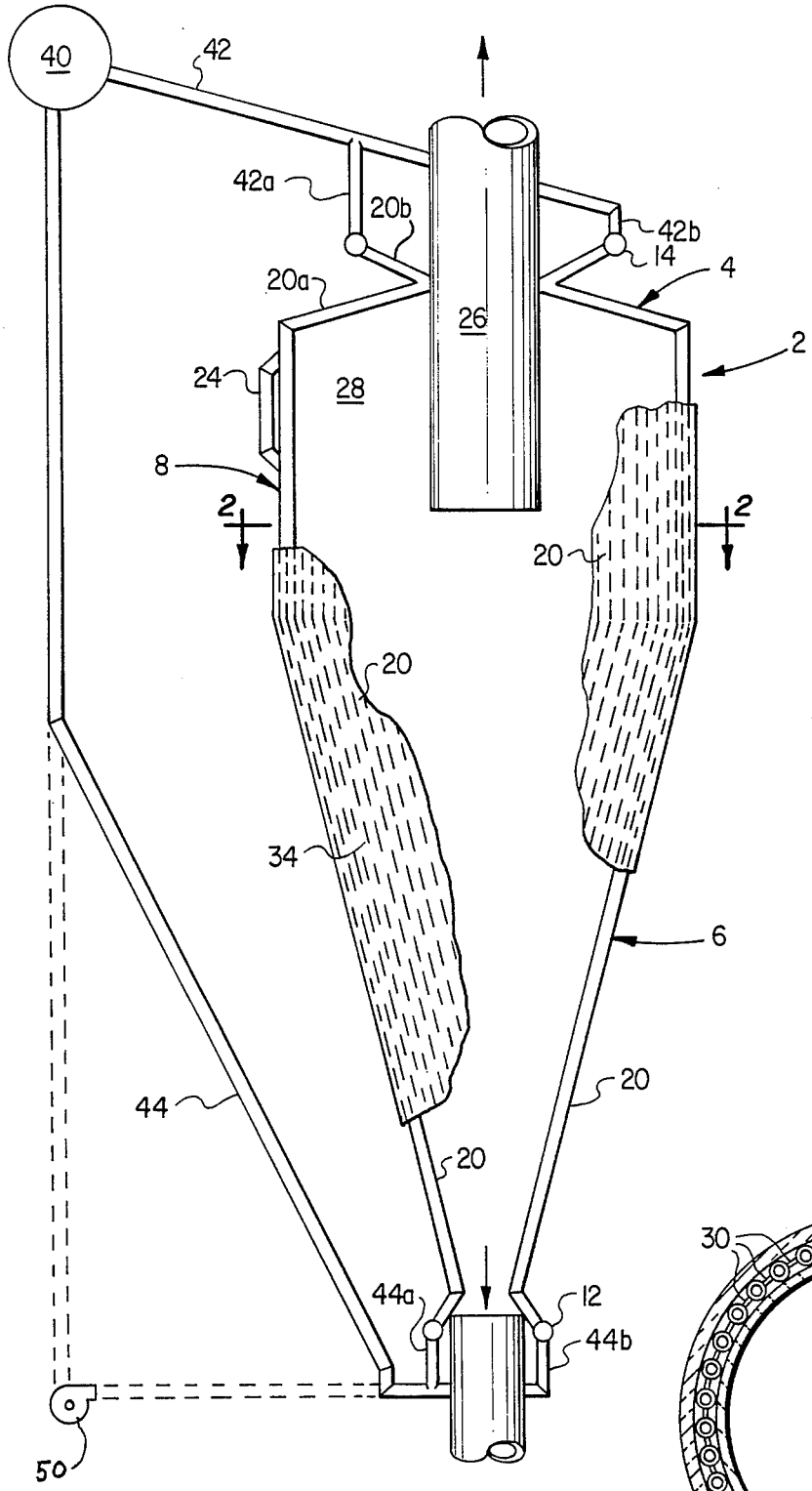
FIG. 1 is a perspective/schematic view of the cyclone separator of the present invention showing a portion of the tubes forming the outer cylinder.

Referring to FIG. 1 of the drawings, the reference numeral 2 refers in general to the cyclone separator of the present invention which includes an upper roof section 4, a conically-shaped lower hopper section 6 and an intermediate cylindrical section 8. A lower ring header 12 is disposed at the lower end of the hopper section 6 and an upper ring header 14 is disposed above the roof section 4.

Each of the sections 4, 6 and 8 are formed by a group of continuous, spaced, parallel tubes 20 spanning the entire length of the separator 2 and connected at their lower ends to the header 12 and at their upper ends to the header 14.

An inlet passage 24 is provided to the interior of the cylindrical section 8 and can be formed by bending a portion of the tubes 20 out of the plane of the cylindrical section 8 as shown in more detail in U.S. Pat. No. 4,746,337 assigned to the assignee of the present invention, the disclosure of which is incorporated by reference.

The roof section 4 is formed by bending the tubes 20 radially inwardly at an angle as shown by the reference numeral **20*a*, and then upwardly at an angle as shown by the reference numeral 20*b***.

An inner pipe, or barrel, 26 is disposed within the cylindrical section 8, is formed from a solid, metallic material, such as stainless steel, and has an upper end portion extending slightly above the roof section 4. The pipe 26 extends immediately within the circular opening defined by the apex formed by the bent tube portions **20*a* and 20*b*. An annular chamber 28 is formed between the outer surface of the pipe 26 and the inner surface of the cylindrical section 8**, for reasons that will be described.

Figure 2:
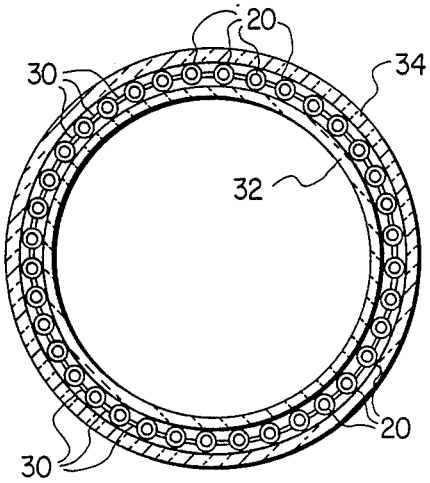
FIG. 2 is a cross-sectional view taken along the line 2—2 of FIG. 1.

As better shown in FIG. 2, the tubes 20 are spaced apart and a continuous fin 30 extends from, and is welded to, adjacent tubes. The structure thus formed is disposed between an inner refractory material 32 and outer insulative material 34. The refractory material 32 can be a relatively thin layer of high conductivity refractory and the insulative material may be of any conventional design.

A natural-circulation steam drum 40 is provided which is connected, via a pipe 42 and two branch pipes 42*a* and 42*b*. to the upper ring header 14. A downcomer pipe 44 and two branch pipes 44*a*and 44*b* connect the steam drum 40 to the lower ring header 12. Thus, water from the steam drum is conveyed by the downcomer pipe 44 to the ring header 12 by gravity and passes upwardly from the latter header through the tubes 20 by natural convection, as will be described.

It is understood that the separator 2 of the present invention is part of a boiler system including a fluidized bed reactor, or the like, (not shown) disposed adjacent the separator. In operation, the inlet passage 24 receives hot gases from the reactor which gases contain entrained fine solid particulate fuel material from the fluidized bed. The inlet passage 24 is arranged so that gases containing the particulate material enter in a direction substantially tangentially to the chamber 28 and thus swirl around in the chamber. The entrained solid particles are thus propelled, by centrifugal forces, against the inner wall of the cylindrical section 8 where they collect and fall downwardly by gravity into the hopper section 6. The relatively clean gases remaining in the chamber 28 are prevented from flowing upwardly by the roof section 4, and thus enter the pipe 26 through its lower end. The gases pass through the length of the pipe 26 before exiting from the upper end of the pipe and are directed to external equipment for further use.

Water, or steam, from the drum 40 is passed, via the pipes 44, 44*a* and 44*b* into the lower header 12 and passes, by convection upwardly through the tubes 20 of the hopper section 6, the cylindrical section 8 and the roof section 4. The heated water, or steam, passes into the upper header 14 and, via the pipes 42*a*, 42*b* and 42 back to the drum 40. The water thus maintains the separator 2 at a relatively low temperature.

Several advantages result from the arrangement of the present invention. For example, heat losses are reduced and the requirement for internal refractory insulation is minimized. Also, the bulk, weight, and cost of the separator of the present invention is much less than that of conventional separators. Further, the need for expensive high temperature refractory-lined ductwork and expansion joints between the reactor and cyclone separator, and between the latter and the heat recovery section is minimized. Still further, the requirement for additional roof circuitry is eliminated.

It is understood that variations in the foregoing can be made within the scope of the invention. For example, the inner pipe 26 can be formed of water tubes in a manner similar to the separator 2 and the latter tube can be connected to the flow circuit including the steam drum 40. Also, a forced circulation system can be used instead of the natural circulation system described above in which case a pump 50 would be provided in the line 44 which receives the fluid from the drum 40 and pumps it to and through the branch conduits 44*a* and 44*b* and the tubes 20.

Other modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A cyclone separator comprising an inner cylinder; a plurality of tubes, the intermediate portions of said tubes extending vertically and circumferentially in a parallel relationship to form an outer cylinder extending around said inner cylinder in a coaxial relationship to define an annular chamber between said cylinders, the upper end portions of aid tubes being bent radially inwardly to form a roof section, and the lower end portions of said tubes being bent radially inwardly to form a conical shaped hopper section; a first ring header connected to the upper ends of said tubes; a second ring header connected to the lower ends of said tubes; means for passing water or steam or a water and steam mixture through said ring headers to circulate said water or steam or water and steam mixture through said tubes to cool said separator; and means for directing gases containing solid particles through said annular chamber for separating the solid particles from said gases by centrifugal forces, the separated gases exiting through said inner cylinder and the separated solids falling to the bottom of said hopper section for disposal or recycle.

2. The separator of claim 1 further comprising refractory means extending around the inner surfaces of said tubes and insulation around said outer surfaces of said tubes.

3. The separator of claim 1 wherein said tubes are disposed in a spaced relationship.

4. The separator of claim 3 further comprising a continuous fin extending from corresponding portions of adjacent tubes to form a gas tight structure.

5. The separator of claim 1 wherein said passing means comprises a steam drum and means connecting said steam drum to said ring headers for circulating said water or steam or water and steam mixture through said steam drum and said tubes.

6. The separator of claim 5 wherein said passing means comprises means for circulating said water or steam or water and steam mixture through said tubes and said steam drum by natural circulation.

7. The separator of claim 5 further comprising pump means for circulating said water or steam or water and steam mixture through said tubes and said steam drum.

* * * * *

US004944250B1

REEXAMINATION CERTIFICATE (1751st)

United States Patent [19]

Seshamani

[11] B1 4,944,250

[45] Certificate Issued * Jul. 14, 1992

[54] CYCLONE SEPARATOR INCLUDING A HOPPER FORMED BY WATER-STEAM COOLED WALLS

[75] Inventor: Venkatraman Seshamani, Gillette, N.J.

[73] Assignee: Foster Wheeler Energy Corporation, Clinton, N.J.

Reexamination Request:
No. 90/002,429, Sep. 3, 1991

Reexamination Certificate for:

| | |
|---|---|
| Patent No.: | **4,944,250** |
| Issued: | **Jul. 31, 1990** |
| Appl. No.: | **330,541** |
| Filed: | **Mar. 30, 1989** |

[ * ] Notice: The portion of the term of this patent subsequent to May 24, 2005 has been disclaimed.

[51] Int. Cl.[5] ..... B04C 5/08
[52] U.S. Cl. ..... 122/20 B; 55/269
[58] Field of Search ..... 55/268, 269; 165/119

[56] References Cited

U.S. PATENT DOCUMENTS

| | | | |
|---|---|---|---|
| 1,890,170 | 12/1932 | Van Brunt | 122/235 A |
| 2,437,294 | 3/1948 | Dalin | 55/269 |
| 2,937,141 | 5/1960 | Helwig | 208/361 |
| 3,327,456 | 6/1967 | Guber et al. | 55/269 |
| 3,470,678 | 10/1969 | Clark et al. | 55/269 |
| 3,732,920 | 5/1973 | Kimmel | 165/119 |
| 4,615,715 | 10/1986 | Seshamani | 55/269 |
| 4,746,337 | 5/1988 | Magol et al. | 55/269 |
| 4,913,711 | 4/1990 | Stewart | 55/269 |

FOREIGN PATENT DOCUMENTS

| | | | |
|---|---|---|---|
| 2527478 | 12/1983 | France . | |
| 54-91602 | 7/1979 | Japan . | |
| 57-35857 | 2/1982 | Japan . | |
| 437124 | 2/1985 | Sweden . | |
| 709821 | 1/1980 | U.S.S.R. . | |
| 567450 | 2/1945 | United Kingdom . | |
| 587240 | 4/1947 | United Kingdom | 55/269 |
| 641357 | 8/1950 | United Kingdom . | |

*Primary Examiner*—Bernard Nozick

[57] ABSTRACT

A cyclone separator formed by a plurality of parallel tubes. A portion of the tubes form a cylinder, a portion are bent radially inwardly to form a roof and a portion are bent to form a hopper. Water is passed through tubes to cool the separator.

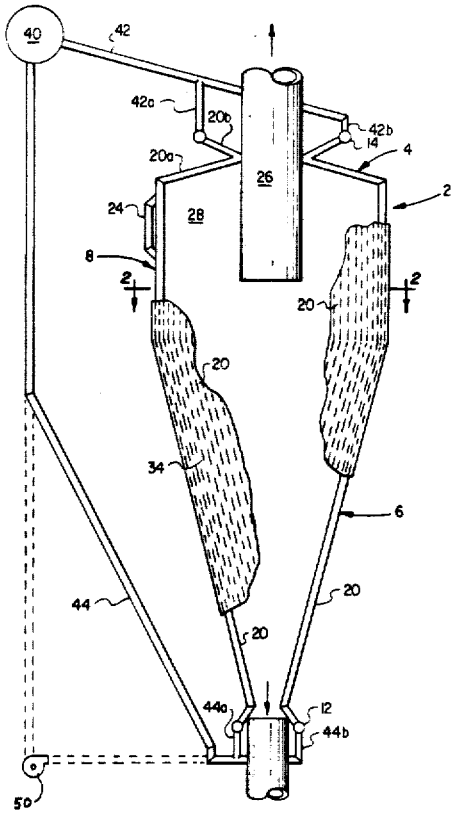

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4 and 7 is confirmed.

Claims 1-3, 5 and 6 are cancelled.

New claims 8-10 are added and determined to be patentable.

*8. The separator of claim 1 or 5 further comprising a continuous fin extending from corresponding portions of adjacent tubes to form a gas tight structure.*

*9. The separator of claim 1 wherein an upper portion of said inner cylinder extends above said roof section; and further comprising a continuous fin extending from corresponding portions of adjacent tubes to form a gas tight structure.*

*10. The separator of claim 1 wherein said first ring header is coaxially aligned with said second ring header; and further comprising a continuous fin extending from corresponding portions of adjacent tubes to form a gas tight structure.*

* * * * *